US005773754A

United States Patent [19]

Yamato

[11] Patent Number: 5,773,754

[45] Date of Patent: Jun. 30, 1998

[54] GAS GENERATING AGENT WITH TRIHYDRAZINO TRIAZINE FUEL

[75] Inventor: Yo Yamato, Hyogo, Japan

[73] Assignee: Daicel Chemical Industries, Ltd., Osaka, Japan

[21] Appl. No.: 867,740

[22] Filed: Jun. 3, 1997

[30] Foreign Application Priority Data

Jun. 3, 1996 [JP] Japan ..... 8-139964

[51] Int. Cl.[6] ..... C06B 43/00

[52] U.S. Cl. ..... 149/36; 280/741

[58] Field of Search ..... 149/36

[56] References Cited

U.S. PATENT DOCUMENTS

| | | | |
|---|---|---|---|
| 3,940,298 | 2/1976 | Beckert et al. | 149/92 |
| 4,543,137 | 9/1985 | Edamura et al. | 149/21 |
| 5,125,684 | 6/1992 | Cartwright . | |
| 5,198,046 | 3/1993 | Bucering et al. | 149/36 |
| 5,380,380 | 1/1995 | Pook et al. | 149/36 |
| 5,472,647 | 12/1995 | Blau et al. | 264/3.1 |
| 5,516,377 | 5/1996 | Highsmith et al. | 149/36 |
| 5,557,062 | 9/1996 | MacLaren et al. . | |

OTHER PUBLICATIONS

D.S. Brown et al., Acta Crystallographica. Section B. Structural Science, B32, 2101 (1976) The Crystal and Molecular Structure of Trihydrazinotrazine.

I. Honda et al., Journal of Japan Industrial Chemistry. 72, 593 (1969) Synthesis and Reaction of Hydrazino–and Semicarbazino–s–triazines (Part of Abstract Only).

*Primary Examiner*—Edward A. Miller

*Attorney, Agent, or Firm*—Birch, Stewart, Kolasch & Birch, LLP

[57] ABSTRACT

A non-azide-type gas generating agent having a high burning rate and a high safety is provided, comprising trihydrazinotriazine as a fuel, and an oxyacid salt, a metal oxide, a metal dioxide or a mixture thereof as an oxidizing agent. The composition is used as a gas generating agent.

14 Claims, 1 Drawing Sheet

GAS GENERATING AGENT WITH TRIHYDRAZINO TRIAZINE FUEL

FIELD OF THE INVENTION

The present invention relates to a gas generating agent which is a working medium in an air bag system for protection of the human body to be mounted on an automobile, an aircraft and the like.

PRIOR ART

Sodium azide is known as a gas generating agent which is currently used in an air bag system. A composition of a gas-generating agent which is formed upon using sodium azide is not particularly problematic with respect to the burning characteristics, and has been widely used. However, sodium azide involves substantially undesirable defects. For example, a fear of explosive decomposition, formation of explosive compounds by reaction with a heavy metal, an environmental pollution which might occur in discharging a large amount of this compound, and the like have been indicated in a large number of patents in the field concerned.

A compound that substitutes sodium azide has been studied to solve the above-mentioned problems. For example, Japanese Patent Publication No. 57,629/1994 describes a gas generating agent containing a transition metal complex of tetrazole or triazole. Further, Japanese Laid-Open (Kokai) No. 254,977/1993 describes a gas generating agent containing triaminoguanidine sulfate, Japanese Laid-Open (Kokai) No. 239,683/1994 a gas generating agent containing carbohydrazide, and Japanese Laid-Open (Kokai) No. 61,885/1995 a gas generating agent comprising a nitrogen-containing nonmetallic compound composed of cellulose acetate and nitroguanidine respectively. Still further, U.S. Pat. No. 5,125,684 indicates the use of nitroguanidine as an energy substance which is co-existent with from 15 to 30% of a cellulose binder.

Problems To Be Solved by the Invention

The above-mentioned nitrogen-containing organic compounds have generally a higher heat value and a higher burning temperature than an azide compound when using an oxidizing agent in an amount sufficient to generate oxygen required for burning carbon, hydrogen and other elements of the molecules of these compounds.

An inflator system for an air bag has to have not only characteristics as a gas generating agent but also such a size that the system itself does not interrupt ordinary operation of an automobile. However, many sodium azide-free gas generating agents involve problems which hinder minimization of a gas generator, namely, a high burning temperature, a high heat value, formation of burnt residues which can hardly be separated through filtration using a filter or a coolant, and the like. Generally, when a gas generator is designed using a gas generating agent which has characteristics such as a high heat value, a high burning temperature and formation of burnt residues which can hardly be filtered, additional units for removal of heat are required, making it impossible to minimize the gas generator itself.

That is, in order to minimize the gas generator, a gas generating agent has to have an appropriate balance of a gas generation efficiency, a heat value, a burning temperature, a filtrability of burned residues, a burning rate, safety, density, appropriate composition of a burnt gas, and the like. Accordingly, the application of the above-mentioned gas generating agent to an air bag system is said to be still unsatisfactory.

SUMMARY OF THE INVENTION

The present inventors have assiduously conducted investigations to solve the above-mentioned problems, and have consequently found that excellent characteristics as a gas generating agent for an air bag are provided by a combination of trihydrazinotriazine and an oxidizing agent. This finding has led to the completion of the present invention.

DETAILED DESCRIPTION OF THE INVENTION

Figure 1:
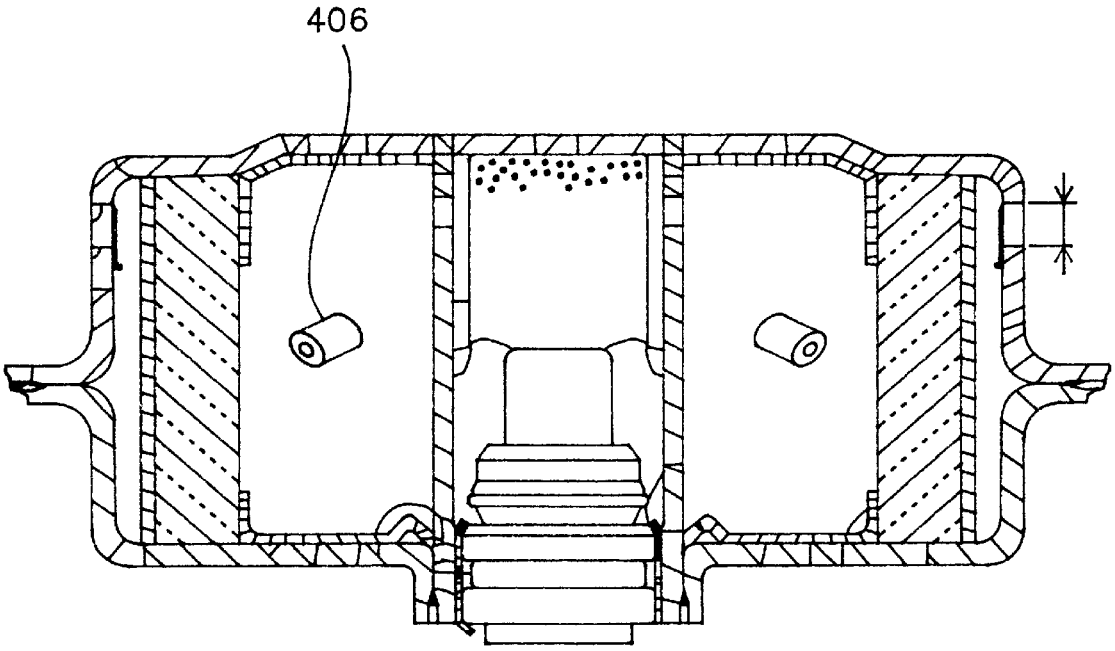
FIG. 1. This Figure shows an inflation system containing therein a composition of a gas generating agent of the invention in the optional form (406) of a hollow cylinderical pellet.

The present invention provides a composition of a gas generating agent for an air bag, the composition being composed mainly of trihydrazinotriazine as a fuel, and an oxyacid salt, a metal oxide, a metal dioxide or a mixture thereof as an oxidizing agent. Trihydrazinotriazine is also called triaminomelamine, and sometimes abbreviated as THT. This compound is synthesized by a simple method, and a synthesis example is described in J. Jpn. Ind. Chem., by I. Honda, T. Keumi and Y. Shimomura, 72, 593 (1969) and Ber., by R. Stolle and K. Krauch, 46, 2337 (1913). Further, according to a literature, for example, Acta Cryst., by D. S. Brown et al., B32, 2101 (1976), this compound is industrially produced by Fisons Chemical.

The content of the fuel in the composition of the gas generating agent varies depending on the type of the oxidizing agent and the oxygen balance. It is preferably between 10 and 60% by weight, more preferably between 20 and 40% by weight. The content of trihydrazinotriazine in the fuel is at least between 25 and 100% by weight, preferably between 50 and 100% by weight. Trihydrazinotriazine is an essential component as a part of the fuel. However, other nitrogen-containing compound fuels can be co-existent for adjusting a gas generation efficiency, a heat value, a burning temperature, a burning rate, safety, density, composition of a burnt gas, and the like.

Examples thereof include tetrazole derivatives such as 5-aminotetrazole, ditetrazole derivatives, triazole derivatives, dicyanediamide, azodicarbonamide, nitroguanidine, guanidine nitrate, oxamide, ammonium oxalate, and hydrazocarbonamide.

A variety of compounds can be used as the oxidizing agent. Examples thereof include an oxyacid salt composed of a cation selected from ammonium, an alkali metal and an alkaline earth metal and a hydrogen-free anion. Examples thereof include nitrates of ammonium, an alkali metal and an alkaline earth metal, such as ammonium nitrate, sodium nitrate, potassium nitrate, magnesium nitrate and strontium nitrate; nitrites of ammonium, an alkali metal and an alkaline earth metal, such as ammonium nitrite, sodium nitrite, potassium nitrite, magnesium nitrite and strontium nitrite; chlorates of ammonium, an alkali metal and an alkaline earth metal, such as ammonium chlorate, sodium chlorate, potassium chlorate, magnesium chlorate and barium chlorate; and perchlorates of ammonium, an alkali metal and an alkaline earth metal, such as ammonium perchlorate, sodium perchlorate, potassium perchlorate, magnesium perchlorate and barium perchlorate; and metal oxides such as CuO, $Cu_2O$, $Co_2O_3$, CoO, $Co_3O_4$, $Fe_2O_3$, FeO, $Fe_3O_4$, $MnO_2$, $Mn_2O_3$, $Mn_3O_4$, NiO, ZnO, $MoO_3$, $CoMoO_4$, $Bi_2MoO_6$ and $Bi_2O_3$.

The above-mentioned compounds may be used in any combination as an oxidizing agent. The content of the oxidizing agent in the gas generating agent is preferably between 40 and 90% by weight, more preferably between 50 and 80% by weight.

The gas generating agent may contain a binder. Examples of the binder include organic binders such as carboxymethyl cellulose, starch, polyvinyl alcohol, microcrystalline cellulose and calcium stearate; and inorganic binders such as molybdenum disulfide, acid clay, talc, bentonite, diatomaceous earth, kaolin, calcium stearate, silica and alumina. The content of the binder in the gas generating agent is between 0 and 15% by weight.

The composition of the gas generating agent in the present invention is characterized in that trihydrazinotriazine is contained as an essential fuel component. Various characteristics can be provided by a combination of fuels, a combination with an oxidizing agent and a combination with a binder.

For example, when a high gas generation efficiency, easy filtration of burnt residuals and a high burning rate are mainly intended, a combination of trihydrazinotriazine and strontium nitrate is quite excellent. Further, when a high gas generation efficiency, a low heat value, a low burning temperature and a high burning rate are mainly intended, a combination of trihydrazinotriazine and potassium nitrate is quite excellent. Still further, when a low heat value, a low burning temperature, easy filtration of burnt residues and a high density are mainly intended, a combination of trihydrazinotriazine and copper oxide is quite excellent.

These requirements for characteristics of the gas generating agent vary depending on the structure of the gas generator, and the gas generator has to have an appropriate balance of various characteristics. The gas generator can be minimized upon effectively utilizing such characteristics of the gas generating agent.

The gas generating agent of the present invention can be obtained preferably by mixing the components in the form of a powder, and the mixing can be conducted by a wet method in the presence of water or the like as required. The gas generating agent can be molded into an appropriate form of granules, pellets, discs or the like. There is a composition in which a burning rate is low but characteristics such as a gas generation efficiency, a heat value, a burning temperature and filtrability of burnt residues are quite excellent. In this case, the problem can be solved by the extrusion molding method.

This extrusion molding method is suitable for mass production of a gas generating agent. Therefore, it is effective also in a composition having a high burning rate. With respect to the extrusion molding, a mono-porous form or a non-porous form by the extrusion-molding can be selected depending on a burning rate.

Further, the present invention provides for an inflator system for air bags produced by using the above-mentioned composition of the gas generating agent. An exemplary inflator system for air bags is shown in FIG. 1, wherein a composition of the instant invention is provided as a gas propellant in the form of a cylindrical hollow pellet (406); however, such a propellant shape is not critical to the use of the instant compositions in an air bag inflator system, or otherwise limiting to the instant discovery. Exemplary air bag inflator systems that can utilize the compositions of the instant invention as gas generants (propellants) therein, include those disclosed in U.S. application Ser. No. 08/829,314 filed on Mar. 31, 1997, by Naboyuki Katsuta, et al., the entire contents of which are incorporated herein by reference.

The gas generating agent of the present invention is especially useful as a gas generating agent for an air bag system for protection of the human body, which system is mounted on an automobile, an aircraft and the like. Trihydrazinotriazine contained in the gas generating agent of the present invention exhibits a long-term stability required for an air bag system, a high safety and excellent burning characteristics.

EXAMPLES

The present invention is illustrated more specifically by referring to the following Examples and Comparative Examples. However, the present invention is not limited thereto.

Examples 1 to 7 and Comparative Examples 1 to 7

Theoretical burning temperatures of a gas generating agent containing trihydrazinotriazine are shown in Examples 1 to 7 in Table 1. Further, a theoretical burning temperature of a gas generating agent containing a transition metal complex of 5-aminotetrazole (5-AT) indicated in Japanese Patent Publication No. 57,629/1994 is shown in Comparative Examples 1 and 2, that of a gas generating agent containing triaminoguanidine nitrate indicated in Japanese Laid-Open (Kokai) No. 254,977/1993 in Comparative Example 3, that of a gas generating agent containing carbohydrazide indicated in Japanese Laid-Open (Kokai) No. 239,683/1994 in Comparative Example 4, and that of a gas generating agent containing cellulose acetate and a nitrogen containing nonmetallic compound indicated in Japanese Laid-Open (Kokai) No. 61,885/1995 in Comparative Examples 5, 6 and 7 respectively. The burning temperatures of the gas generating agents in the Comparative Examples are high as a whole, which is undesirable. Even so, burning temperatures in Comparative Examples 1 and 2 are approximately equal to those in Examples 2, 5 and 7. However, in Comparative Examples 1 and 2, low melting burnt residues such as ZnO and CuO are melted, which is undesirable. On the other hand, in Examples 2, 5 and 7, only SrO which is a high-melting burnt residue is formed, and is easily filtrable through a filter or a coolant. Thus, it is desirable.

TABLE 1

| | Composition (wt. %) | Burning temperature (K) |
|---|---|---|
| Example 1 | trihydrazinotrizine/$KNO_3$ (28.7/71.3) | 2131 |
| Example 2 | trihydrazinotriazine/$Sr(NO_3)_2$ (27.8/72.2) | 2506 |
| Example 3 | trihydrazinotriazine/CuO (17/83) | 1358 |
| Example 4 | trihydrazinotriazine/nitroguanidine/CuO (11.3/13.2/75.5) | 1603 |
| Example 5 | trihydrazinotriazine/$Sr(NO_3)_2$/carboxymethyl cellulose (16.3/73.7/10) | 2459 |
| Example 6 | trihydrazinotriazine/$KNO_3$/kaolin (27.8/69.2/3) | 2110 |
| Example 7 | trihydrazinotriazine/guanidine nitrate/$Sr(NO_3)_2$ (23/10/67) | 2443 |
| Comparative Example 1 | $Zn(5\text{-}AT)_2/Sr(NO_3)_2$ (44.0/56.0) | 2411 |
| Comparative Example 2 | $[Cu(5\text{-}AT)_2.\frac{1}{2}H_2O]/Sr(NO_3)_2$ (40/58) | 2390 |
| Comparative Example 3 | triaminoguanidine nitrate/$KClO_4$ (57.9/42.1) | 2911 |
| Comparative | carbohydrazide/$KClO_4$/CaO (39/61/10) | 2825 |

TABLE 1-continued

| | Composition (wt. %) | Burning temperature (K) |
|---|---|---|
| Example 4 | | |
| Comparative Example 5 | cellulose acetate/triacetin/$KClO_4$/nitroguanidine (8/2/55/35) | 2834 |
| Comparative Example 6 | cellulose acetate/triacetin/$KClO_4$/triaminoguanidine nitrate (8/4/57/31) | 2893 |
| Comparative Example 7 | cellulose acetate/triacetin/$KClO_4$/5-aminotetrazole (10/5/65/20) | 2928 |

Examples 8 to 11

A burning rate of a gas generating agent containing trihydrazinotriazine, a density of pellets of a gas generating agent, and an amount of a gas generated area shown in Table 2. The burning rate was measured at a pressure of 70 kgf/cm$^2$.

TABLE 2

| | Composition (wt. %) | Burning rate (mm/sec) | Density (g/cm$^3$) | Amount of a gas generated (mol/100 g gas generating agent) |
|---|---|---|---|---|
| Example 8 | trihydrazinotriazine/CuO (17/83) | 3.2 | 2.88 | 1.19 |
| Example 9 | trihydrazinotriazine/$Sr(NO_3)_2$ (27.8/72.2) | 14.0 | 2.07 | 2.29 |
| Example 10 | trihydrazinotriazine/$KNO_3$ (28.7/71.3) | 18.8 | 1.79 | 2.11 |
| Example 11 | trihydrazinotriazine/nitroguanidine/CuO (11.3/13.2/75.5) | 6.8 | 2.86 | 1.43 |

Examples 12 to 13

The results of a test of measuring a heat resistance of a gas generating agent containing trihydrazinotriazine are shown in Table 3. When the agent was allowed to stand in a constant-temperature bath of 105° C. for 411 hours, the weight loss was slight, and no change in the appearance was observed.

TABLE 3

| | Composition (wt. %) | Weight loss (%) |
|---|---|---|
| Example 12 | trihydrazinotriazine/CuO (17/83) | −0.43 |
| Example 13 | trihydrazinotriazine/$Sr(NO_3)_2$ (27.8/72.2) | −0.56 |

Examples 14 to 18

The results of tests for measuring a friction sensitivity and a drop hammer sensitivity of gas generating agents containing trihydrazinotriazine are shown in Table 4. It is found that the sensitivities of these gas generating agents are low and the safety thereof is high.

TABLE 4

| | Composition (wt. %) | Friction sensitivity (kgf) | Drop hammer sensitivity (cm) |
|---|---|---|---|
| Example 14 | trihydrazinotriazine (100) | >36 | >100 |
| Example 15 | trihydrazinotriazine/CuO (17/83) | >36 | >100 |
| Example 16 | trihydrazinotriazine/$Sr(NO_3)_2$ (27.8/72.2) | >36 | >100 |
| Example 17 | trihydrazinotriazine/$KNO_3$ (28.7/71.3) | >36 | >100 |
| Example 18 | trihydrazinotriazine/CuO (8.5/19.8/71.8) | >36 | >100 |

Effects of the Invention

As is clear from the above-mentioned results, the gas generating agent of the present invention has a large number of preferable characteristics as compared with the conventional gas generating agents, making it possible to minimize a gas generating agent and apply it to an air bag system.

I claim:

1. A composition of a gas generating agent for an air bag, said composition comprising:

trihydrazinotriazine as a fuel, and an oxyacid salt, a metal oxide , a metal dioxide (a metal double oxide) or a mixture thereof as an oxidizing agent.

2. The composition of the gas generating agent as recited in claim 1, wherein:

the oxidizing agent is an oxyacid salt, a metal oxide, a metal dioxide or a mixture thereof, said oxyacid salt being composed of (i) a cation selected from ammonium, an alkali metal and an alkaline earth metal, and (ii) a hydrogen-free anion, said metal oxide being selected from the group consisting of an oxide of copper, cobalt, nickel, zinc, molybdenum and bismuth, and said metal dioxide being selected from the group consisting of a dioxide of copper, cobalt, nickel, zinc, molybdenum and bismuth.

3. The composition of the gas generating agent as recited in claim 2, wherein the hydrogen-free anion is selected from the group consisting of nitric acid, nitrous acid, chloric acid and perchloric acid.

4. The composition of the gas generating agent as recited in any one of claims 1 to 3, wherein the oxidizing agent is potassium nitrate or strontium nitrate.

5. The composition of the gas generating agent as recited in any one of claims 1 to 2, wherein the oxidizing agent is copper oxide.

6. The composition of the gas generating agent as recited in any one of claims 1 to 3, wherein trihydrazinotriazine is contained in the composition an amount of from 10 to 40% by weight, and the oxidizing agent is contained in the composition in an amount of from 60 to 90% by weight.

7. The composition of the gas generating agent as recited in any one of claims 1 to 3, wherein a binder is optionally contained in the composition, and said binder is selected from the group consisting of carboxymethyl cellulose, starch, polyvinyl alcohol, microcrystalline cellulose, molybdenum disulfide, acid clay, talc, bentonite, diatomaceous earth, kaolin, calcium stearate, silica, alumina and a mixture thereof.

8. An inflator system which contains the composition of the gas generating agent as recited in any one of claims 1 to 3.

9. A composition of a gas generating agent for an air bag, said composition mainly comprising:

trihydrazinotriazine as a fuel, and an oxyacid salt, a metal oxide, a metal dioxide (a metal double oxide) or a mixture thereof as an oxidizing agent.

10. The composition of the gas generating agent as recited in claim 9, wherein:

the oxidizing agent is an oxyacid salt, a metal oxide, a metal dioxide or a mixture thereof, said oxyacid salt being composed of (i) a cation selected from ammonium, an alkali metal and an alkaline earth metal, and (ii) a hydrogen-free anion, said metal oxide being selected from the group consisting of an oxide of copper, cobalt, nickel, zinc, molybdenum and bismuth, and said metal dioxide being selected from the group consisting of a dioxide of copper, cobalt, nickel, zinc, molybdenum and bismuth.

11. The composition of the gas generating agent as recited in claim 10, wherein the hydrogen-free anion is selected from the group consisting of nitric acid, nitrous acid, chloric acid and perchloric acid.

12. A composition of a gas generating agent for an air bag, said composition consisting essentially of:

trihydrazinotriazine as a fuel, and an oxyacid salt, a metal oxide, a metal dioxide (a metal double oxide) or a mixture thereof as an oxidizing agent.

13. The composition of the gas generating agent as recited in claim 12, wherein:

the oxidizing agent is an oxyacid salt, a metal oxide, a metal dioxide or a mixture thereof, said oxyacid salt being composed of (i) a cation selected from ammonium, an alkali metal and an alkaline earth metal, and (ii) a hydrogen-free anion, said metal oxide being selected from the group consisting of an oxide of copper, cobalt, nickel, zinc, molybdenum and bismuth, and said metal dioxide being selected from the group consisting of a dioxide of copper, cobalt, nickel, zinc, molybdenum and bismuth.

14. The composition of the gas generating agent as recited in claim 2, wherein the hydrogen-free anion is selected from the group consisting of nitric acid, nitrous acid, chloric acid and perchloric acid.

* * * * *